US007044639B2

(12) United States Patent
Chang

(10) Patent No.: US 7,044,639 B2
(45) Date of Patent: May 16, 2006

(54) RECLOSEABLE PLASTIC BAGS

(75) Inventor: Chia-Hsiang Chang, Troy, MI (US)

(73) Assignee: Fantapak International Corp., Troy, MI (US)

( * ) Notice: Subject to any disclaimer, the term of this patent is extended or adjusted under 35 U.S.C. 154(b) by 376 days.

(21) Appl. No.: 10/460,466

(22) Filed: Jun. 13, 2003

(65) Prior Publication Data

US 2004/0252917 A1 Dec. 16, 2004

(51) Int. Cl.
*B65D 33/16* (2006.01)
*B27N 3/08* (2006.01)

(52) U.S. Cl. ..... 383/64; 264/239

(58) Field of Classification Search ..... 383/64–65; 264/239, 293
See application file for complete search history.

(56) References Cited

U.S. PATENT DOCUMENTS 5,131,121 A * 7/1992 Herrington et al. ..... 24/436
5,131,212 A 7/1992 Grey et al.
5,189,764 A * 3/1993 Herrington et al. ..... 24/384
5,664,299 A * 9/1997 Porchia et al. ..... 24/400
5,836,056 A * 11/1998 Porchia et al. ..... 24/400
5,956,815 A * 9/1999 O'Connor et al. ..... 24/30.5 R
6,595,689 B1 * 7/2003 Borchardt et al. ..... 383/64
6,612,002 B1 * 9/2003 Savicki ..... 24/585.1

* cited by examiner

*Primary Examiner*—Jes F. Pascua
(74) *Attorney, Agent, or Firm*—Bingham McCutchen LLP

(57) ABSTRACT

A recloseable bag with slider end stops prevents sliders from slipping off the end of fastener elements and being lifted off the end of the fastener elements. The recloseable bag includes a bag, slider end stops, fastening elements and a slider. The fastener elements are configured to interlock when pressed together. The slider includes flanges and a pair of slider ends. The slider slides along the length of the fastener elements to interlock and unlock the fastener elements. The flanges prevent the slider from being lifted from beneath the fasteners elements and the end stops. The slider ends are configured to receive and engulf end stops. The end stops are configured to protrudes above the slider to abut slider 110 while also allowing entry into slider.

10 Claims, 1 Drawing Sheet

RECLOSEABLE PLASTIC BAGS

BACKGROUND OF THE INVENTION

1. Field of the Invention

This present invention relates to recloseable packages. More specifically, the present invention relates to a recloseable plastic bag configured with circular slider end stops.

2. Description of the Prior Art

Generally, recloseable plastic bags are provided with sliding closure clips ("sliders"). These sliders travel over a pair of male and female fastener elements at an opening of the plastic bag to close and open the opening. One problem with these types of recloseable plastic bags is that the sliders slip off the fastener elements in a direction axially aligned with the fastener elements after an extended period of use. Once these sliders have slid off the fastener elements they cannot be repositioned. As a result, the reusability feature of the plastic bag is destroyed requiring the plastic bag to be discarded.

Designs have been developed that attempt to prevent sliders from slipping off of fastener elements. Some designs attempt to solve the problem by offsetting the height of the end of the bag where the fastener elements terminate. Offsetting the height of the end of the bag results in the slider slipping off the fastener elements in a direction that is perpendicular to the fastener elements. Other designs embed or emboss stoppers at the end of the bag where the fastener elements terminate. Embossed or embedded stop also results in the slider slipping off the fastener elements in a direction that is perpendicular to the fastener elements.

Therefore, there is a need for a recloseable plastic bag configured with slider end stops and method of that prevent sliders from slipping off fastener elements in a direction axially aligned with the fastener elements. In addition, there is a need for a recloseable plastic bag configured with slider end stops that prevent sliders from slipping off fastener elements in a direction perpendicular to the fastener elements.

SUMMARY OF THE INVENTION

According to embodiments of the present invention, a recloseable bag and a method of providing a recloseable are provided. The recloseable bag with circular slider end stops of the present invention provides a method of preventing sliders from slipping off fastener elements in a direction axially aligned with the fastener elements. The recloseable bag with slider end stops also provides a method of preventing sliders from slipping off fastener elements in a direction perpendicular to the fastener elements.

A recloseable bag including a bag, a set of fasteners coupled to, and extending axially along, an open portion of the bag, a slider straddling the set of fasteners operable to slide axially along the length of the set of fastener elements, and a set of end stops coupled to, and positioned at, opposing ends of the set of fastener elements configured to protrude above the slider and allow entry into the slider. The set of fastener elements are configured to open and re-close and the slider is configured to engulf the set of end stops and prevent the slider from sliding off the ends of the set of fastener elements and lifted from beneath the set of end stops.

In an embodiment of the invention, the slider further includes a set of flanges configured to extend along the length of the slider and extend beneath the set of fastener elements and the set of end stops.

In an embodiment of the invention, the slider further includes a set of slider ends configured to receive and engulf the set of end stops. Each end in the set of ends includes a slot at a mid-portion. Each of the slots at each of the mid-portions is axially aligned with the set of fastener elements

BRIEF DESCRIPTION OF THE DRAWINGS

The details of the present invention, both as to its structure and operation can best be understood by referring to the following description with reference to the accompanying drawings in which.

DETAILED DESCRIPTION OF THE INVENTION

Figure 1:
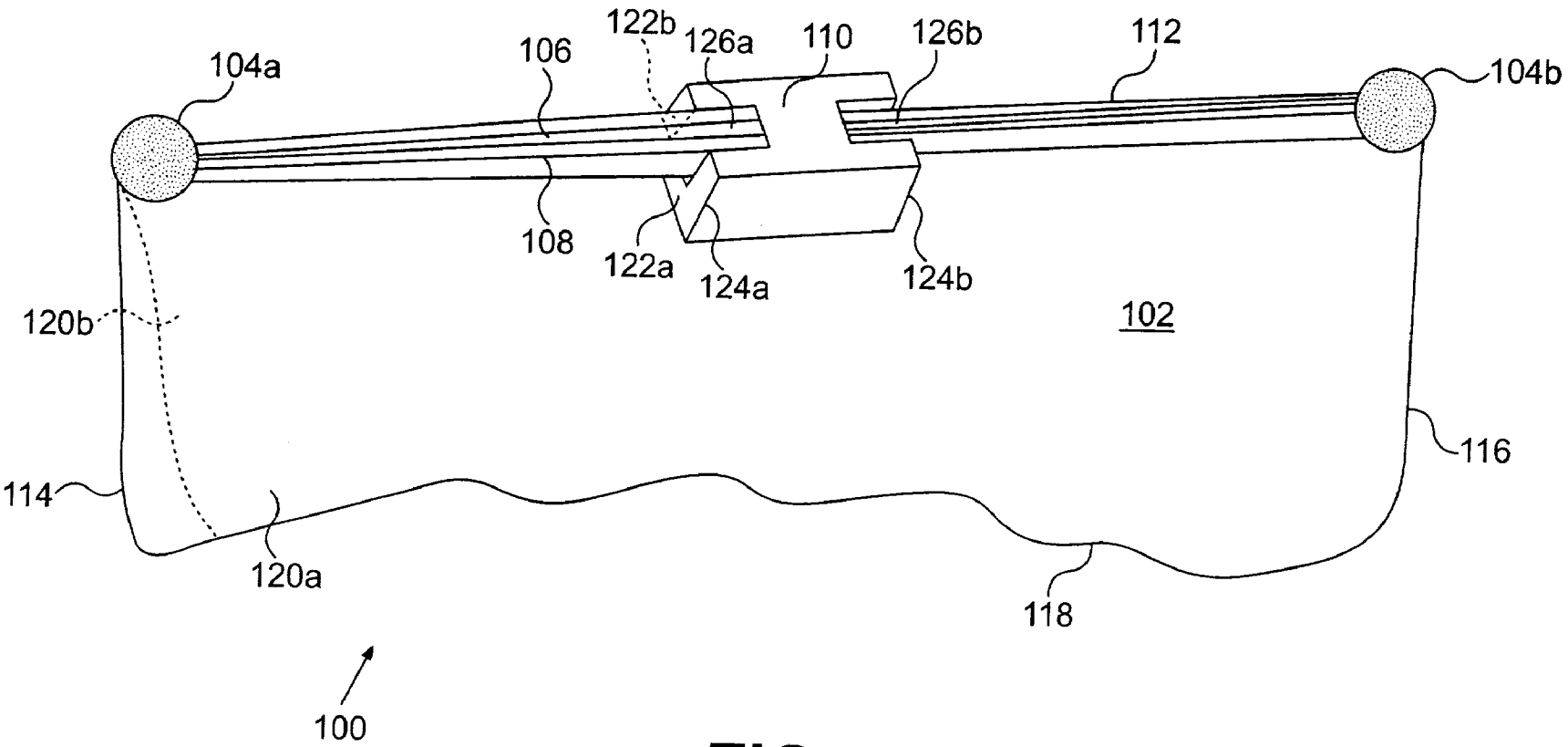
FIG. 1 illustrates a recloseable bag with circular slider end stops.

The present invention is now described more fully hereinafter with reference to the accompanying drawings that show a preferred embodiment of the present invention. The present invention, however, may be embodied in many different forms and should not be construed as limited to embodiments set forth herein. Appropriately, embodiments are provided so that this disclosure will be thorough, complete and fully convey the scope of the present invention.

The recloseable bag with circular slider end stops of the present invention provides a method of preventing sliders from slipping off fastening elements in a direction axially aligned with the fastening elements. The recloseable bag with slider end stops also provides a method of preventing sliders from slipping off fastening elements in a direction perpendicular to the fastening elements.

An exemplary diagram of a recloseable bag configure with slider end stops as implemented by the present invention, is shown in FIG. 1. In the FIG. 1 embodiment, the recloseable bag 100 configured with slider end stops includes a bag 102, slider end stops 104*a*–104*b*, fastening elements 106 and 108 and slider 110. Recloseable bag 102 may be made from sheets of material including, but not limited to, polyethylene, plastic, nylon, canvas, and the like. In a preferred embodiment of the present invention, recloseable bag 102 is formed by two polyethylene sheets 120*a*–120*b*. The two polyethylene sheets 120*a*–120*b* of material are joined at a first side 114, a second side 116 and at a bottom end 118. The two polyethylene sheets 120*a*–120*b* may be joined in any manner suitable for the type of material employed. The two polyethylene sheets 120*a*–120*b* at top end 112 remain un-joined so as to form a mouth like opening for recloseable bag 102.

Each sheets 120*a*–120*b* at top end 112 includes a fastener element, such as fastener elements 106 and 108. In the FIG. 1 embodiment of the present invention, the fastener element 106 is shaped to compliment the fastener element 108 in a male and a female configuration. The configuration enables the fastener element 106 to interlock with the fastener element 108 when pressed together. The fastener elements 106 and 108 may be configured from materials including, but not limited to, polyethylene, plastic, nylon, canvas and the like. The fastener element 106 attaches to a first one of the sheets 120*b* at top end 112 and extends along the length of top end 112. The fastener element 108 attaches to a second one of the sheets 120*a* at top end 112 and extends along the length of top end 112.

In the FIG. 1 embodiment of the present invention, the slider 110 includes flange 122*a*, flange 122*b*, slider end 124*a* and slider end 124*b*. The slider 110 may be configured from materials including, but not limited to, polyethylene, plastic, nylon, canvas and the like. The slider 110 straddles and mates with fastener elements 106 and 108. Slider 110 may slide along the length of the fastener elements 106 and 108 in a first direction to interlock the fastener element 106 with the fastener element 108. The slider 110 may slide along the length of the fastener elements 106 and 108 in a second direction to separate the interlocked fastener elements 106 and 108 from one another.

The flanges 122*a* and 122*b* are configured to extend along the length of slider 110, extend beneath fastener element 106, fastener element 108, and extend partially beneath end stop 104*a* and end stop 104*b*. The flanges 122*a* and 122*b* prevent the slider 110 from being lifted from beneath the fasteners elements 106 and 108 when the slider 110 is slid along the length of the fastener elements 106 and 108 and when the slider 110 engages end stops 104*a* and 104*b*.

The slider ends 124*a* and 124*b* may be configured to partially receive and engulf end stops 104*a* and 104*b* respectively. In the FIG. 1 embodiment of the present invention, each slider end 124 has a slotted mid-portion 126 operable to partially receive and engulf end stops 104*a* and 104*b* respectively. The slotted mid-portion 126*a* is axially aligned with fastener elements 106 and 108, extends to the slider end 124*a* and flanges 122, and creates an opening to partially receive end stop 104*a*. The slotted mid-portion 126*b* is axially aligned with fastener elements 106 and 108, extends to the slider end 124*b* and flanges 122, and creates an opening to partially receive end stop 104*b*. The back of each slotted mid-portion 126 and the flanges 122*a* and 122*b* provides the surfaces of slider 110 that abut with end stops 104*a* and 104*b*.

Each of the end stops 104 may be respectively positioned on a point along fastener elements 106 and 108 and configured to abut, and be partially engulfed by, slider 110. The end stops 104 may be configured from materials including, but not limited to, polyethylene, plastic, nylon, canvas and the like. The end stops 104 may be configured into shapes including, but not limited to, circles, rectangles and squares. In the FIG. 1 embodiment of the present invention, each of the end stops 104 is position at a respective end point 128 on fastener elements 106 and 108. Each of the end stops 104 has a circular configuration, extends partially above the slotted mid-portions 126 of slider 110 and below the flanges 122*a* and 122*b* of slider 110, and has a width allowing entry to respective slotted mid-portions 126.

Each of the end stops 104 are formed by ultrasonically heating the ends of fastener elements 106 and 108. Ultrasonically heating the ends of fastener elements 106 and 108 applies pressure to the opposing sides of the ends. The structure applying the pressure has a convex configuration corresponding to the shape of the end stops. This results in two identical concave and hatched circular surfaces being impressed into the ends of fastener elements 106 and 108 bag. The impression expands the surface of the bag creating a circular raised portion surrounding the outer edges where impression occurred. The circular raised portion surrounding the outer edges of the impression extends partially above the slotted mid-portions 126 of slider 110 and below the flanges 122*a* and 122*b* of slider 110, and has a width allowing entry to respective slotted mid-portions 126. The concaved portion of each end stop in the set of end stops 104 provides a surface for holding the plastic bag by thumb and opposing finger when being opened and closed.

While specific embodiments of the present invention have been illustrated and described, it will be understood by those having ordinary skill in the art that changes may be made to those embodiments without departing from the spirit and scope of the invention.

What is claimed is:

1. A recloseable bag comprising:

a bag;

a set of fastener elements coupled to, and extending axially along, an open portion of the bag, wherein the set of fastener elements are configured to open and re-close;

a slider straddling the set of fastener elements operable to slide axially along the length of the set of fastener elements; and a set of end stops coupled to, and positioned at, opposing ends of the set of fastener elements, wherein each end stop is configured with an outer boundary portion and an inner portion on a first side and an outer boundary portion and inner portion on a second side, wherein each of the outer boundary portions extends above each of the inner portions to create ends stops with a concave configuration for holding the recloseable plastic bag and that protrude above the slider and allow entry into the slider;

wherein the slider is configured to engulf the set of end stops and prevent the slider from sliding off the ends of the set of fastener elements and lifted from beneath the set of end stops.

2. The recloseable bag according to claim 1, wherein the slider further comprises a set of flanges configured to extend along the length of the slider and extend beneath the set of fastener elements and the set of end stops.

3. The recloseable bag according to claim 1, wherein the slider further comprises a set of slider ends configured to receive and engulf the set of end stops.

4. The recloseable bag according to claim 3, wherein each end in the set of ends includes a slotted mid-portion.

5. The recloseable bag according to claim 4, wherein each of the slotted mid-portions is axially aligned with the set of fastener elements.

6. A method of providing recloseable bags, the method comprising:

providing a bag;

providing a set of fastener elements coupled to, and extending axially along, an open portion of the bag, wherein the set of fastener elements are configured to open and re-close;

providing a slider straddling the set of fastener elements operable to slide axially along the length of the set of fastener elements; and providing a set of end stops coupled to, and positioned at, opposing ends of the set of fastener elements, wherein each end stop is configured with an outer boundary portion and an inner portion on a first side and an outer boundary portion and inner portion on a second side, wherein each of the outer boundary portions extends above each of the inner portions to create ends stops with a concave configuration for holding the recloseable plastic bag and that protrude above the slider and allow entry into the slider;

wherein the slider is configured to engulf the set of end stops and prevent the slider from sliding off the ends of the set of fastener elements and lifted from beneath the set of end stops.

7. The method according to the claim 6, wherein the step of providing a slider further comprises a set of flanges configured to extend along the length of the slider and extend beneath the set of fastener elements and the set end stops.

8. The method according to claim 6, wherein the step of providing a slider further comprises a set of slider ends configured to receive and engulf the set of end stops.

9. The method according to claim 8, wherein each end in the set of slider ends includes a slotted mid-portion.

10. The method according to claim 9, wherein each of the slotted mid-portions is axially aligned with the set of fastener elements.

* * * * *